US006118361A

United States Patent [19]

Ogawa

[11] Patent Number: 6,118,361

[45] Date of Patent: Sep. 12, 2000

[54] MOLDED COIL A METHOD AND A MOLD FOR PRODUCING THE SAME

[75] Inventor: Shinji Ogawa, Yokkaichi, Japan

[73] Assignee: Sumitomo Wiring Systems, Ltd., Japan

[21] Appl. No.: 09/352,293

[22] Filed: Jul. 12, 1999

[30] Foreign Application Priority Data

Jul. 15, 1998 [JP] Japan ..... 10-200568

[51] Int. Cl.[7] ..... H01F 27/02; H01F 27/829

[52] U.S. Cl. ..... 336/96; 336/90; 336/192; 336/198

[58] Field of Search ..... 336/208, 198, 336/192, 90, 96; 29/602.1

[56] References Cited

U.S. PATENT DOCUMENTS 4,989,574 2/1991 Abe ..... 123/617
5,111,175 5/1992 Sugiura et al. .
5,659,246 8/1997 Togo et al. ..... 324/207.15

FOREIGN PATENT DOCUMENTS 2109395 of 1972 France .
526 194 of 1972 Switzerland .

*Primary Examiner*—Michael L. Gellner
*Assistant Examiner*—Anh Mai
*Attorney, Agent, or Firm*—Anthony J. Casella; Gerald E. Hespos; Michael J. Porco

[57] ABSTRACT

A molded coil is provided for preventing the entrance of water, oil and the like into the inside a coil. The molded coil 1 is comprised of a coil 2 provided therein and having the outer surfaces thereof covered by a resin material, and a molded element 17 formed by curing the resin material. Bulging portions 6 are provided at the opposite ends of a shaft 5 of a bobbin 3 of the coil 2. The molded element 17 is so formed as to cover the coil 2 from the outer surfaces of the two bulging portions 6 over the outer circumferential surface of the wound wire 4. On the outer surface of the lower bulging portion 6 is provided an embossed engaging portion in the form of a closed ring along the entire circumference of the bulging portion 6. Thus, even if water, oil or the like enters through mold detaching holes 18, it will not reach the inside of the coil 2.

8 Claims, 6 Drawing Sheets

MOLDED COIL A METHOD AND A MOLD FOR PRODUCING THE SAME

BACKGROUND OF THE INVENTION

1. Field of the Invention

The present invention relates to a molded coil, a method and a mold for producing the same.

2. Description of the Related Art

A prior art molded coil is identified by the numeral 100 in FIG. 6 and is disclosed in U.S. Pat. No. 5,111,175. The molded coil 100 is produced as follows. First, a coil 103 is produced by winding a wire 101 around a shaft 104 of a bobbin 102. The coil 103 is placed in a mold (not shown) to cover the outer surfaces of the coil 103 with a resin material. A molded element 106 is formed when the resin material is cured.

Disks 105 project radially from opposite ends of the shaft 104 of the bobbin 102. The disk 105 and the molded element 106 contact the outer circumferential surface of the wound wire 101 at boundary portions A near the outer peripheral edges of the disk 105. Thus, any water or oil that enters through these boundary portions A, may reach the inside of the coil 103.

The present invention was developed in view of the above problem, and an object thereof is to provide a molded coil which can prevent the entrance of water, oil and the like into the inside of a coil and to provide a method and a mold for producing such a molded coil.

SUMMARY OF THE INVENTION

According to the invention, there is provided a molded coil, comprising a coil and a molded element. The coil comprises a bobbin having a shaft and at least one, and preferably two bulging portions that bulge out at an angle different from 0° or 180° and preferably substantially radially of the shaft from substantially opposite ends of the shaft. The coil further includes a wire wound around the shaft. The molded element is formed by molding a molding material to be substantially integral to the coil. The molded element substantially covers the coil at least from portions of the outer surfaces of the two bulging portions over the outer circumference surface of the wound wire.

According to a preferred embodiment of the invention, there is provided a molded coil, comprising a coil and a molded element. The coil comprises a bobbin having a shaft and two bulging portions bulging out radially of the shaft from the opposite ends of the shaft. The coil further has a wire wound around the shaft. The molded element is formed by molding a resin material to be made integral to the coil. The molded element covers the coil at least from the outer surfaces of the two bulging portions over the outer circumference surface of the wound wire. Accordingly, the molded element covers from the outer surfaces of the two bulging portions of the coil over the outer circumferential surface of the wound wire. Thus, the entrance of water, oil and the like into the inside of the coil via the bulging portions can be prevented.

Preferably, a layer of the molding or resin material on at least one bulging portion is formed with mold detaching holes which are recessed. The mold detaching holes preferably are formed by the contact of the one bulging portion with a part of a mold when the molding or resin material is molded in the mold. The mold detaching holes are located near the shaft at a distance from the outer edge of the one bulging portion. Thus, as compared with a case where the mold detaching holes are provided near the outer edge of the one bulging portion, a distance between the mold detaching holes and the inside of the coil is longer. Therefore, even if water, oil or the like enters through the mold detaching holes, it is unlikely to reach the inside of the coil.

Further preferably, the at least one bulging portion is provided with an embossed or indented engaging portion to be engaged with the layer of the molding or resin material formed on the at least one bulging portion. Accordingly, the bulging portion and the resin layer can be engaged with a stronger force.

The embossed or indented engaging portion preferably defines a substantially closed ring that substantially surrounds the mold detaching holes along the substantially entire circumference of the at least one bulging portion. Accordingly, even if water, oil or the like enter through the mold detaching holes, it is prevented from reaching the coil via the outer edges of the bulging portions since the looped embossed or indented engaging portion is so provided as to surround the mold detaching holes along the entire circumference of the at least one bulging portion. Thus, the watertight effect can be improved.

Most preferably, the mold detaching holes are filled with a filler. Accordingly, the entrance of water, oil and the like through the mold detaching holes can be avoided since the mold detaching holes are filled with the filler. Further, to prevent such an entrance through the joined portions of the disk and the molded element in the prior art molded coil, the filler has to be applied to the entire outer periphery of the disk, thereby requiring a large amount of sealant and also more labor and time. However, according to the present invention, a smaller amount of filler and less time and labor are required since it is sufficient to fill only the mold detaching holes with the filler.

According to a further preferred embodiment, the molded element substantially covers at least a portion of the shaft, thereby preferably substantially surrounding the complete coil.

According to the invention, there is further provided a method for producing a molded coil. The method comprises placing a coil in a mold. The coil may be formed by winding a wire around a shaft of a bobbin having one or more, preferably two bulging portions bulging out at an angle different from 0° or 180°, preferably substantially radially of the shaft out from the substantially opposite ends of the shaft. The method further comprises supporting the bobbin by bobbin supports projecting inside the mold, thereby defining a molding material space between at least one bulging portion and the corresponding surface of the mold, filling a molding material at least into the molding material space defined in the mold and curing the molding material. Accordingly, since the resin space is provided outside the bulging portion of the bobbin, the outer surfaces of the bulging portions can be covered securely with the molding or resin material.

According to a further preferred embodiment of the invention, there is further provided a method for producing a molded coil by placing a coil in a mold. The coil may be formed by winding a wire around a shaft of a bobbin having two bulging portions bulging out radially of the shaft from the opposite ends of the shaft. The method then includes filling a molding or resin material into the mold. Bobbin supports for supporting the bobbin project inside the mold, and the bobbin supports support the bobbin when the coil is placed in the mold, thereby defining a resin space, into which the molding or resin material flows, below one bulging portion.

Preferably, the method further comprises the step of providing a layer of the molding material formed on the one bulging portion with mold detaching holes by the bobbin supports being located there, and preferably filling the mold detaching holes with a filler.

Further preferably, a layer of the molding or resin material formed on the one bulging portion is provided with mold detaching holes by the bobbin supports being located there, and the mold detaching holes are filled with a filler. Accordingly, the entrance of water, oil and the like through the mold detaching holes can be avoided since the mold detaching holes are filled with the filler. Further, to prevent such an entrance through the joined portions of the disk and the molded element in the prior art molded coil, the filler has to be applied to the entire outer periphery of the disk, thereby requiring a large amount of sealant and also more labor and time.

According to the invention, there is further provided a mold for producing a molded coil by placing thereinto a coil. The coil is formed by winding a wire around a shaft of a bobbin having one or more, preferably two bulging portions bulging out at an angle different from 0° or 180°, preferably substantially radially of the shaft out from the substantially opposite ends of the shaft, and filling thereinto a molding material. The mold comprises bobbin supports for supporting the bobbin projecting inside the mold, wherein the bobbin supports support the bobbin when the coil is placed in the mold, thereby defining a molding material space, into which the molding material flows, between the at least one bulging portion and the corresponding surface of the mold.

According to a further preferred embodiment of the invention, the bobbin supports are dimensioned and positioned such that a layer of the molding material formed on the at least one bulging portion is provided with mold detaching holes.

Preferably, the molding material space has such a configuration that an embossed or indented engaging portion of the at least one bulging portion is engaged with the layer of the molding material formed on the at least one bulging portion.

These and other objects, features and advantages of the present invention will become more apparent upon a reading of the following detailed description and accompanying drawings.

DETAILED DESCRIPTION OF THE PREFERRED EMBODIMENTS

Figure 1:
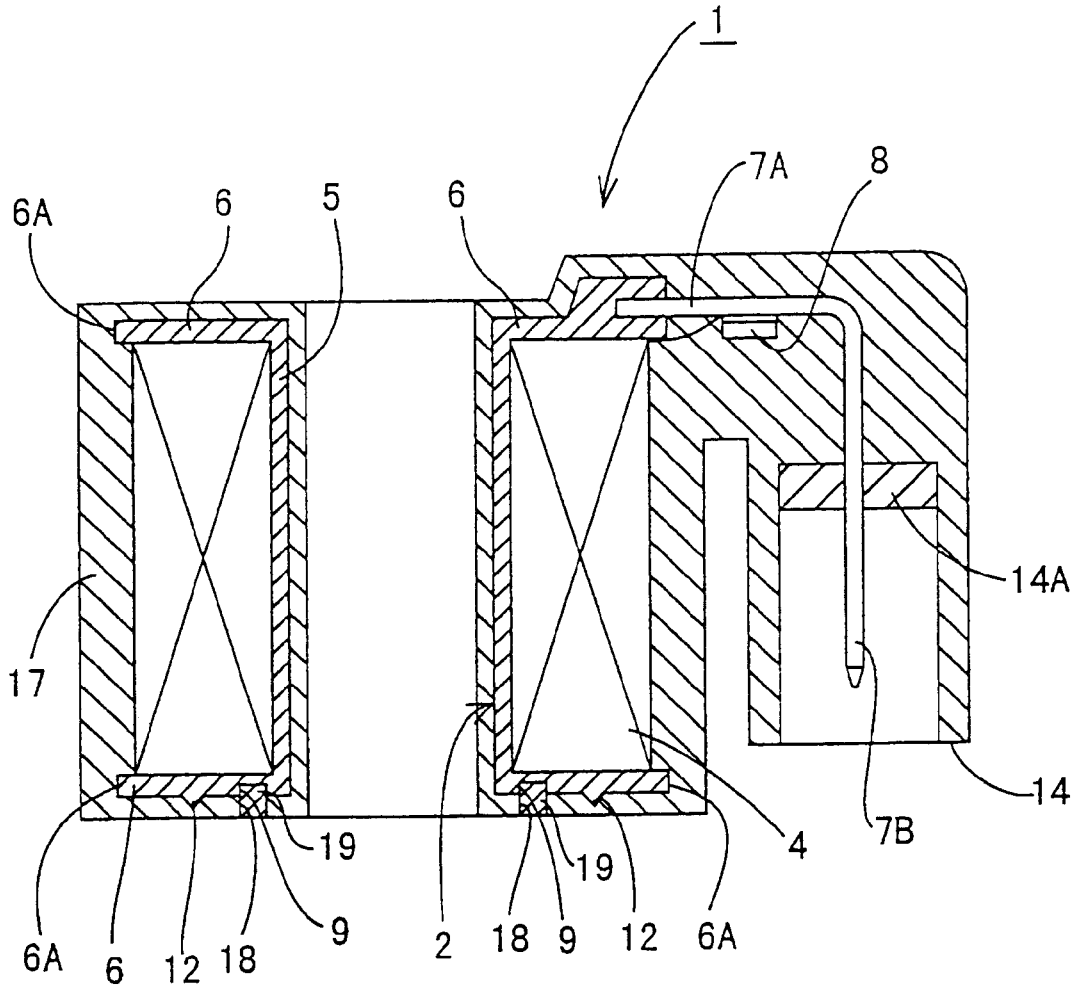
FIG. 1 is a side view in section of a molded coil according to one embodiment of the invention.

A molded coil in accordance with the invention is identified by the numeral 1 in FIG. 1. A coil 2 is provided inside the molded coil 1, and the outer circumferential surface thereof is at least partially secondarily covered, e.g. by a resin material. A molded element 17 is formed e.g. by curing this resin material.

Figure 2:
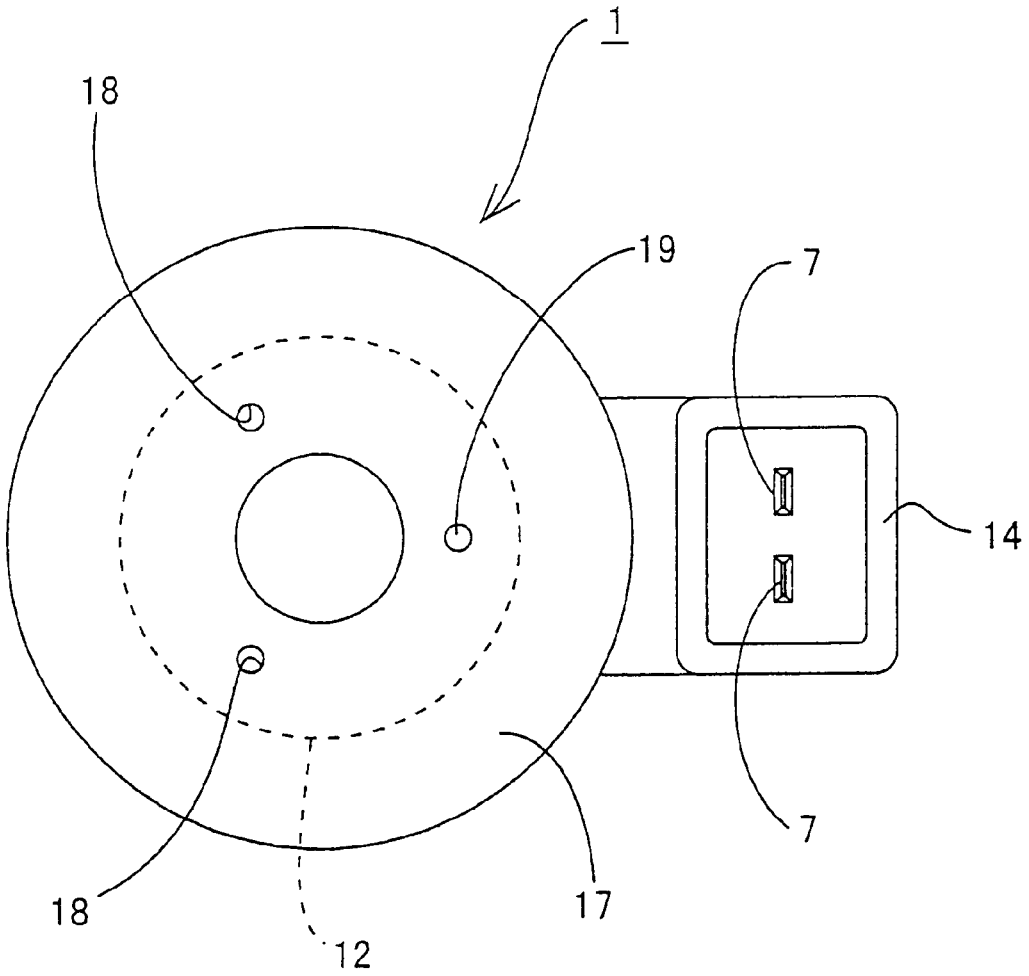
FIG. 2 is a front view of the molded coil.
Figure 3:
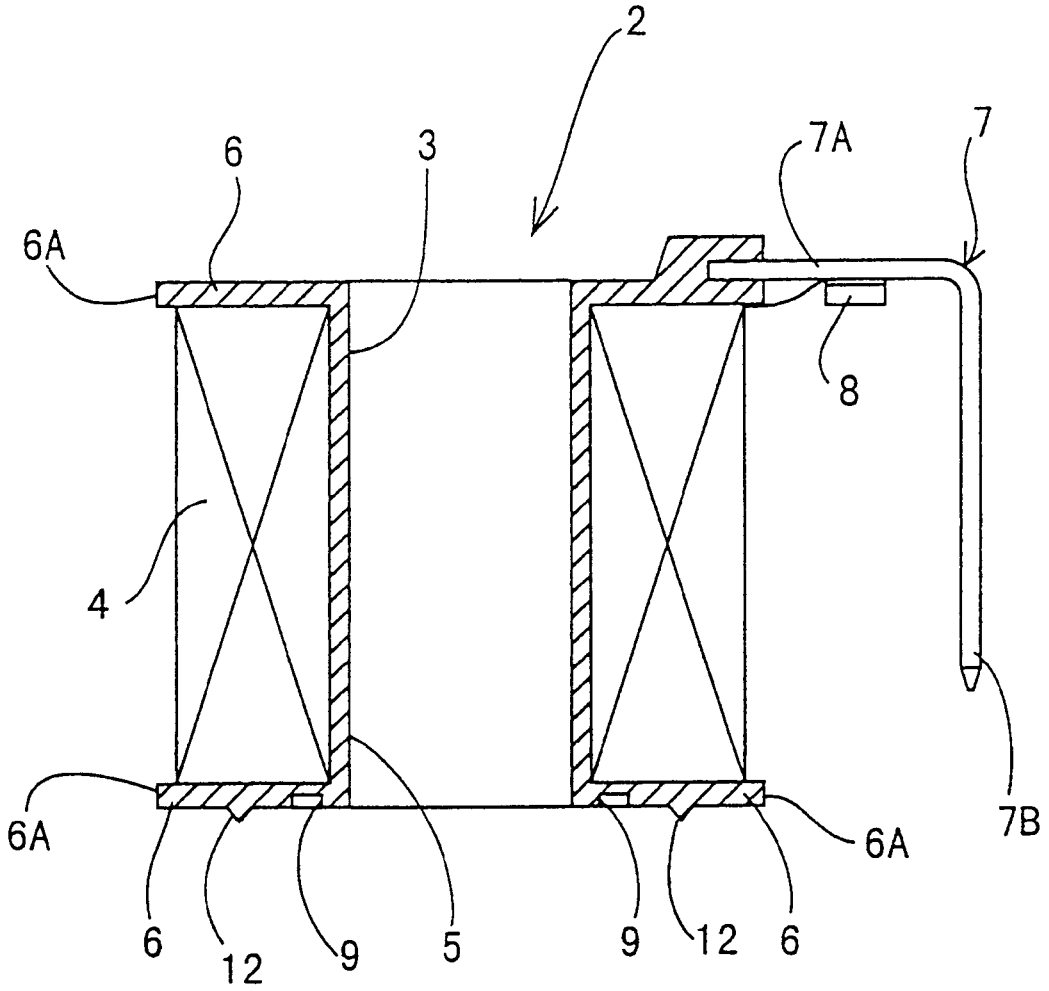
FIG. 3 is a side view in section of a coil before being covered by a resin material.

The coil 2 is provided with a bobbin 3 and a wire 4, as shown in FIG. 3. The bobbin 3 is made e.g. of synthetic resin and is comprised of a cylindrical shaft 5 and a pair of substantially disk-shaped bulging portions 6 which bulge out at an angle different from 0° or 180°, preferably substantially radially of or substantially normal to the shaft 5 (or the longitudinal axis thereof). The bulging portions 6 are preferably at substantially the top and bottom ends of the shaft 5. The wire 4 is wound around the shaft 5, and the opposite ends of the wire 4 are both drawn at a distal end, preferably an upper right corner in FIG. 3. At the right end of the upper bulging portion 6 in FIG. 3, a pair of terminals 7 are formed by insert-molding (see also FIG. 2). One end of each terminal 7 is embedded in the upper surface of the upper bulging portion 6, and a remaining portion thereof extends substantially in the radial direction of the shaft 5 (horizontally extending portion 7A) and is then bent at an angle different from 0° or 180°, preferably substantially normal to the radial direction, e.g. downward as shown in FIG. 3. The other end of each terminal 7 acts as a tab portion 7B to be connected with a terminal of an unillustrated mating connector. A coupling portion 8, with which the opposite ends of the wire 4 are coupled, projects from the horizontal extending portion 7A.

Receiving portions 9 in the form of recesses are formed in the lower bulging portion 6 in FIG. 3. The receiving portions 9 are formed in the outer surface of the lower bulging portion 6 in positions near the shaft 5 and distanced from an outer edge 6A. There are e.g. three receiving portions 9 which are equidistant from the center of the shaft 5 and are arranged substantially angularly equally spaced apart. The receiving portions 9 are engageable with bobbin supports 11 provided in a mold 10, according to an embodiment of the invention. On the outer surface of the bulging portion 6 where the receiving portions 9 are formed is provided an annular embossed engaging portion 12 in such a manner as to surround the receiving portions 9 along the entire outer periphery of the bulging portion 6. The engaging portion 12 is comprised of a series of protuberances preferably having a triangular cross section.

Next, the molded element 17 is described with reference to FIGS. 1 and 2. The molded element 17 is integral to the coil 2 while covering substantially the entire outer surfaces 4*a* of the coil 2 or wound wire 4. As described later, the molded element 17 is formed by placing the coil 2 in the mold 10, filling a resin material into the mold and curing the filled resin material. The molded member 17 covers from the outer surfaces of the two bulging portions 6 of the coil 2 substantially over the outer circumferential surface of the wound wire 4. Further, a resin layer having a specified thickness is formed inside the shaft 5 of the bobbin 3. A resin layer formed on the outer surface of the lower bulging portion 6 in FIG. 1 is formed with mold detaching holes 18 in conformity with the receiving portions 9. In the mold detaching holes 18 are filled and solidified sealant 19 (as a filler).

The molded element 17 includes a connector portion 14 which is so formed as to substantially surround the terminals 7 (from a lateral side or a side at an angle different from 0° or 180°, preferably substantially normal to the longitudinal extension direction of the tab portion 7B). The connector portion 14 substantially surrounds the pair of terminals 7 with the leading ends of the tab portions 7B of the terminals 7 spaced apart by a specified distance, and is substantially open downward.

The unillustrated mating connector is connectable with the connector portion 14. A sealing or resin member 14A is injected and solidified at the closed end opposite to the opening so as to prevent the entrance of water, oil and the like.

Figure 4:
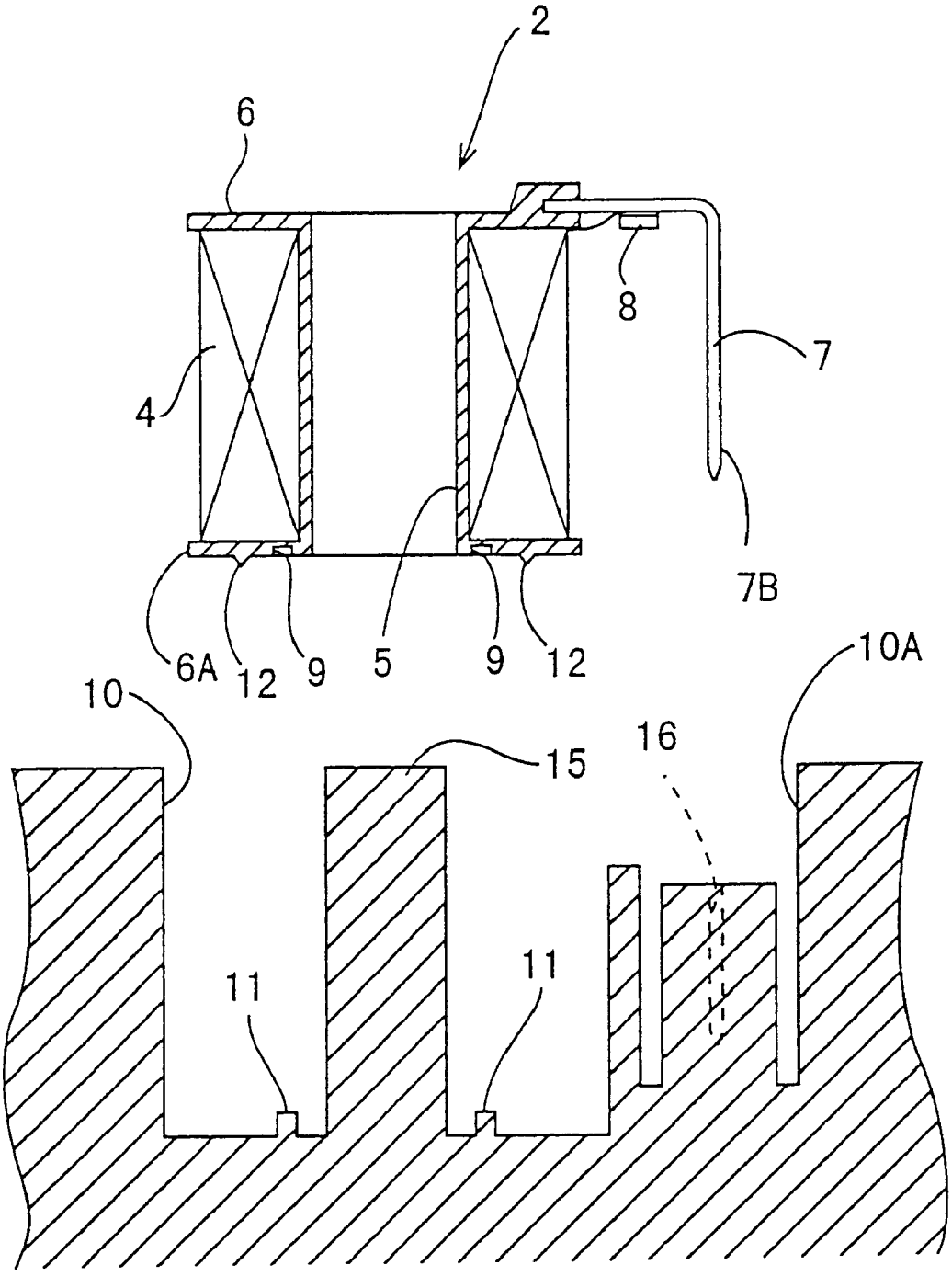
FIG. 4 is a side view in section of a mold according to an embodiment of the invention.

Next, the mold 10 is described with reference to FIG. 4. A center projection 15 having a diameter slightly smaller than the inner diameter of the shaft 5 projects from the bottom wall of the mold 10. The e.g. three bobbin supports 11 (only two of them are shown) project near the center projection 15. The bobbin supports 11 are provided in positions substantially conforming to the positions of the receiving portions 9 of the bulging portion 6 of the bobbin 3, and are fitted into the receiving portions 9 to support the coil 2. Thus, the mount position of the bobbin 3 can be decided by the engagement of the bobbin supports 11 and the receiving portions 9. The projecting height of the bobbin supports 11 is higher than the depth of the receiving portions 9. When the bobbin supports 11 are fitted into the receiving portions 9, a molding material space or resin space 13 having a specified dimension between the outer surface of the bulging portion 6 and the mold 10 is defined. The molding or resin material flows into this resin space 13, thereby substantially covering at least part of the outer surface 6B of the bulging portion 6 with the resin material. When the molded coil 1 is molded, the mold detaching holes 18 of the molded element 17 are left open where the bobbin supports were located.

The mold 10 also is provided with a connector forming portion 10A which can receive the terminals 7. Tab recesses 16 into which the tab portions 7B are at least partially insertable are formed in the bottom surface of the connector forming portion 10A. The connector portion 14 is formed to substantially surround a space around the tabs 7B by filling the resin material into the connector forming portion 10A.

Next, a method or an operation of placing the coil 2 in the mold 10 and filling the resin material into the mold 10 according to an embodiment of the invention is described.

Figure 5:
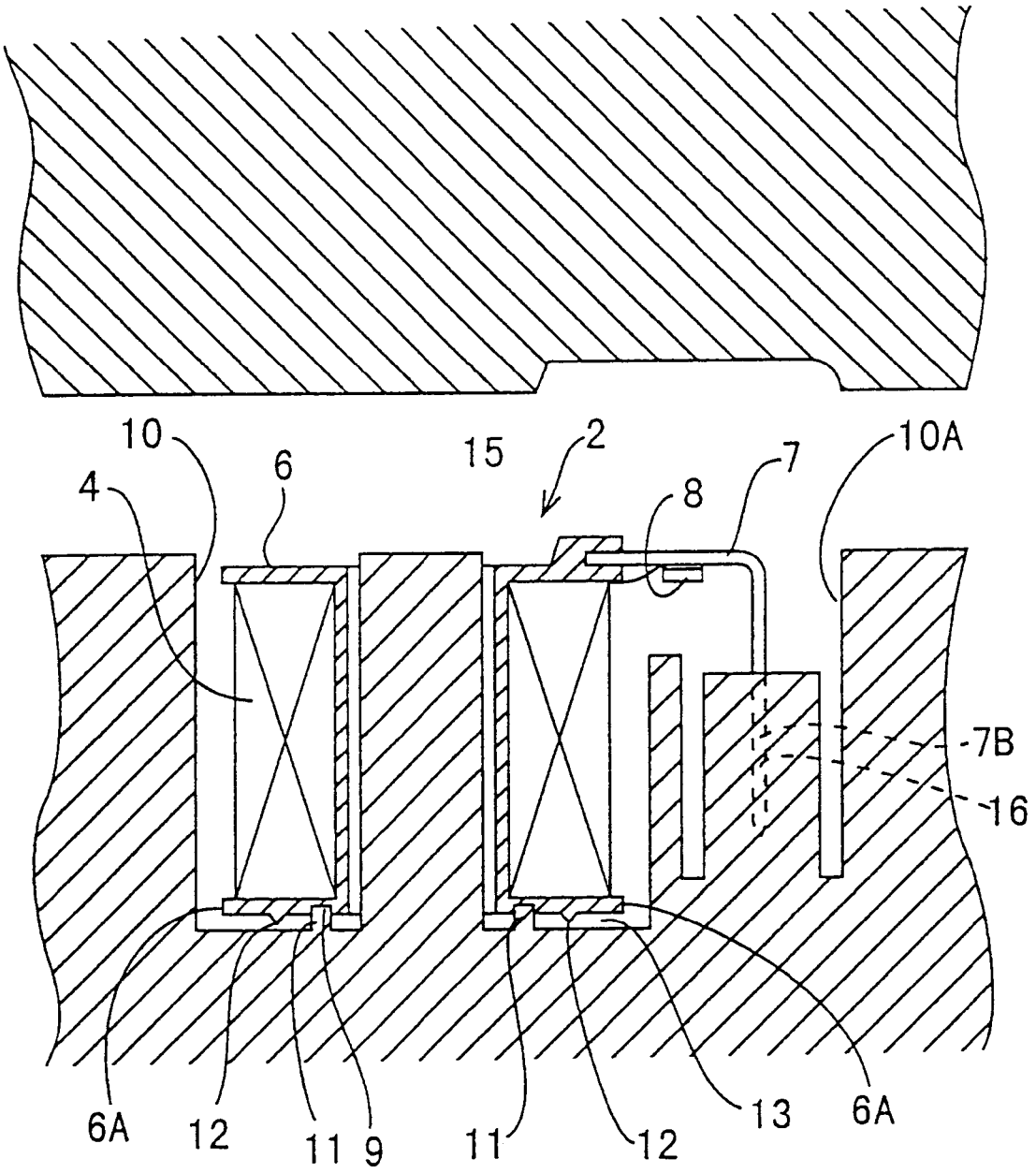
FIG. 5 is a side view in section of the coil placed in the mold.
Figure 6:
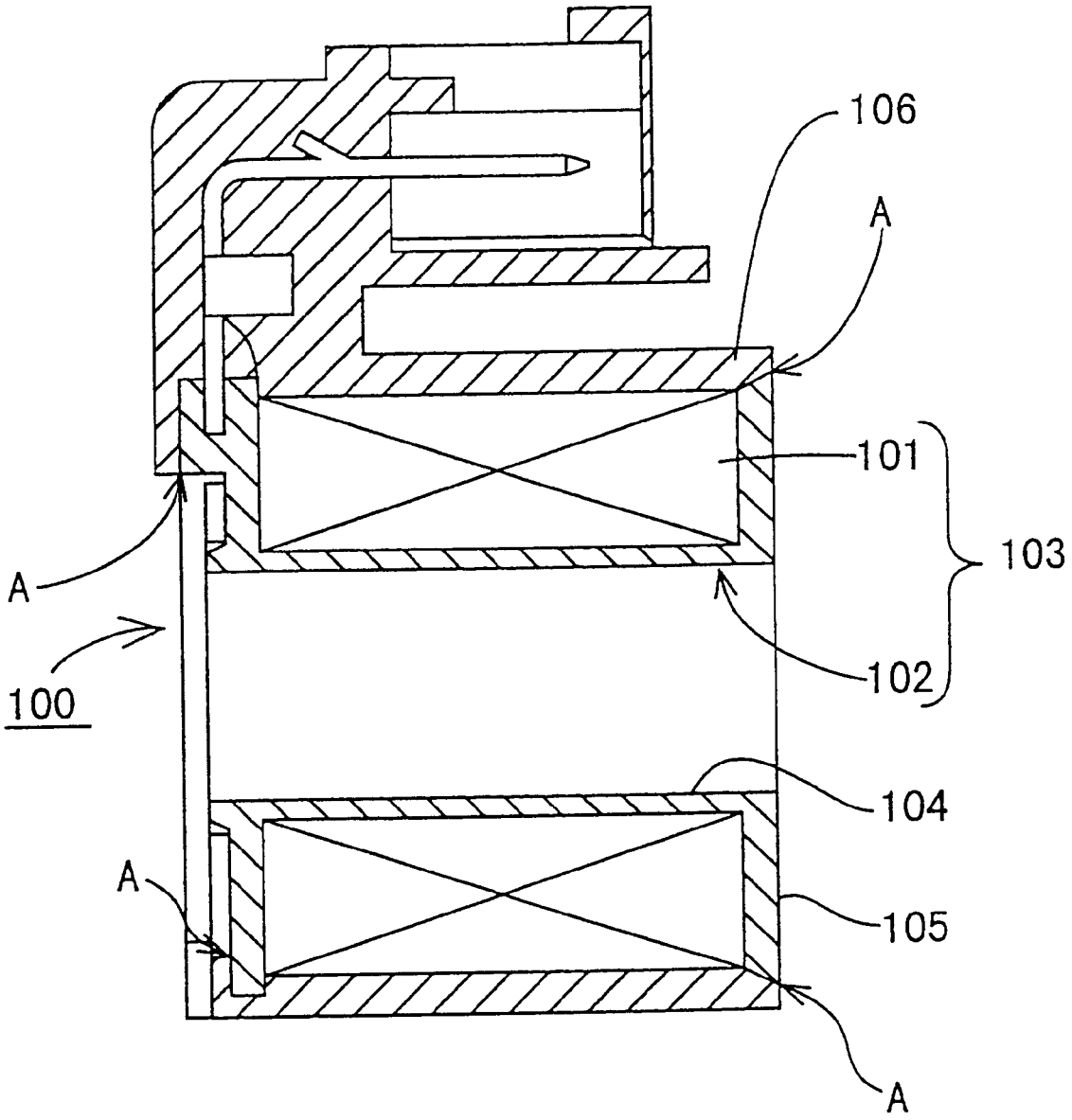
FIG. 6 PRIOR ART
FIG. 6 is a side view in section of a prior art molded coil.

As shown in FIG. 5, the coil 2 is placed or positioned in the mold 10. Specifically, the shaft 5 is fitted down on the center projection 15 and the bobbin supports 11 and the receiving portions 9 are aligned substantially with each other. At this time, the terminals 7 are located inside the connector forming portion 10A and the tab portions 7 are pushed into the tab recesses 16.

With the coil 2 set in the mold 10 in this way, the molding or resin material is filled and solidified in the mold 10. The resin material is cured to form the molded element 17, and the molded coil 1 is taken out of the mold 10. Subsequently, the sealant 19 is filled and substantially solidified or cured in the mold detaching holes 18 formed by the bobbin supports 11.

The molded coil of this embodiment is covered by the molded element 17 from the outer surfaces of the two bulging portions 6 of the coil 2 substantially over the outer circumferential surface of the wound wire 4. This prevents water, oil and the like from entering the inside of the coil 2 from the bulging portions 6.

The mold detaching holes 18 are formed near or in proximity to the shaft 5 of the bobbin 3 at a distance from the outer edge 6A of the bulging portion 6. Thus, as compared with a case where the mold detaching holes 18 are formed near the outer edge of the bulging portion 6, a distance or path length between the mold detaching holes 18 and the inside of the coil 2 is longer, because of the interposed cylindrical shaft 5 and/or bulging portion(s) 6. Therefore, even if water, oil or the like enters through the mold detaching holes 18, it is unlikely to reach the inside of the coil 2.

Further, since the embossed engaging portion 12 to be engaged with the resin layer formed on the bulging portion 6 is provided, the bulging portion 6 and the resin layer can be engaged with a stronger force.

Additionally, even if water, oil or the like enters through the mold detaching holes 18, it is prevented from reaching the coil 2 via the outer edges of the bulging portions 6 since the looped embossed engaging portion 12 is provided to substantially surround the mold detaching holes 18 along the entire circumference of the bulging portion 6 in a radially more outward position with respect to the mold detaching holes 18 or a radially interposed position between the mold detaching holes 18 and the coil 2. Thus, the watertight effect can be improved.

Further, since the mold detaching holes 18 are filled with the sealant 19, the entrance of water, oil and the like through the mold detaching holes can be avoided. To prevent such an entrance through the joined portions A of the disk 105 and the molded element 106 in the prior art molded coil 100, the filler has to be applied to the entire outer periphery of the disk 105, thereby requiring a large amount of sealant and also labor and time. The joined portions A are exposed to the outside and are bent at right angles. If the sealant 19 is used at such projected portions, there is a high possibility that the sealant 19 is peeled off after being solidified. Accordingly, a separate member would need to be made of rubber of synthetic resin to prevent the entry of water. This would require extra time and labor. However, this embodiment of the invention requires only a small amount of sealant 19 and less time and labor since it is sufficient to fill the sealant 19 only in the mold detaching holes 18. Furthermore, since the sealant 19 is filled and solidified in the recessed mold detaching holes 18, there is a low possibility that it is peeled off.

The present invention is not limited to the foregoing embodiments. For example, the following embodiments also are embraced by the technical scope of the present invention as defined in the claims.

Although the embossed engaging portion 12 provided on the bulging portion is comprised of a series of projections in the foregoing embodiment, it may be comprised of a series of recesses according to the present invention.

The embossed engaging portion 12 needs not be in the form of a closed ring. For example, it may be in the form of a polygon such as a triangle or rectangle. Further, it is sufficient for the embossed engaging portion to be substantially closed or ring-shaped and the embossed engaging portion needs not be entirely located outwardly from the mold detaching holes.

The bulging portions 6 and the shaft 5 of the bobbin 3 need not be cylindrical. For example, they may have a polygonal cross section (e.g. triangular, squared) or elliptical.

In the foregoing embodiment, the receiving portions 9 are formed in the bulging portion 6 and the coil 2 is set while being positioned with respect to the mold 10 by the engagement of the bobbin supports 11 and the receiving portions 9. However, the bulging portion 6 may be simply placed in the mold 10 without providing the receiving portions 9.

Although the sealant 19 is used as the filler in the foregoing embodiment, plugs e.g. made of rubber or synthetic resin fittable into the mold detaching holes 18 may be used according to the invention.

Additionally to the two outer bulging portions 6 there may be provided on the shaft 5 one or more intermediate bulging portions e.g. for dividing the wound wire(s) 4 in two or more coil elements.

Even though the molded coil has been described with an embodiment having one embossed engaging portion 12 provided on one bulging portion 6, two or more embossed engaging portions may be provided on one or more bulging portions.

What is claimed is:

1. A molded coil, comprising:

a coil comprising a bobbin having a shaft and spaced apart bulging portions bulging out at an angle from the shaft, the bulging portions having outer surfaces facing outwardly on said bobbin, and a wire wound around the shaft, the wound wire having an outer circumferential surface; and a molded element formed by molding a molding material around the coil, wherein the molded element covers the coil at least from portions of the outer surfaces of the bulging portions over the outer circumferential surface of the wound wire, a layer of the molding material on at least one bulging portion being formed with mold detaching holes which are recessed, the mold detaching holes being located near the shaft and at a distance from an outer edge of the respective bulging portion, the mold detaching holes being filled with a filler.

2. A molded coil according to claim 1, wherein the at least one bulging portion is provided with an embossed engaging portion engaged with the layer of the molding material formed on the at least one bulging portion.

3. A molded coil according to claim 2, wherein the embossed engaging portion is a closed ring surrounding the mold detaching holes and an end of the shaft.

4. A molded coil according to claim 1, wherein the molded element covers at least a portion of the shaft, thereby surrounding the complete coil.

5. A method for producing a molded coil, comprising the steps of:

forming a coil by winding a wire around a shaft of a bobbin having spaced apart bulging portions bulging out at an angle from the shaft, placing the coil in a mold, supporting one said bulging portion on bobbin supports projecting inside the mold, thereby defining a molding material space between at least the supported bulging portion and the surface of the mold having the bobbin supports, filling a molding material at least into the molding material space defined in the mold, the filling of the molding material comprising having the molding material surround the bobbin supports, curing the molding material, removing the coil with the cured molding material thereon from the mold such that the bobbin supports leave mold detaching holes, and filling the mold detaching holes with a sealant.

6. A mold for producing a molded coil by placing a coil into the mold, the coil being formed by winding a wire around a hollow shaft of a bobbin, the bobbin having spaced apart bulging portions bulging radially out from the shaft, the hollow shaft defining an inside diameter and the bulging portion defining an outside diameter for the bobbin, and the molded coil being produced by filling a molding material into the mold, the mold comprising:

an annular bottom wall, a cylindrical outer wall projecting from the bottom wall and defining an inside diameter greater than the outside diameter of the bulging portion, a center support projecting from the bottom wall and disposed concentrically within the outer wall, the center support defining an outside diameter less than the inside diameter of the hollow shaft, bobbin supports for supporting the bobbin, the bobbin supports projecting from the bottom wall inside the mold, wherein the bobbin supports support the bobbin when the coil is placed in the mold, thereby defining a molding material space, into which the molding material flows, between the bulging portions and the cylindrical outer wall of the mold and between the hollow shaft and the center support of the mold and further between the bottom wall of the mold and portions of the bulging portion surrounding the bobbin supports.

7. A molded coil, comprising:

a coil comprising a bobbin having a hollow shaft and spaced apart bulging portions bulging radially outwardly from the shaft, the bulging portions each having an outer circumferential edge and an outer surface extending between the hollow shaft and the outer circumferential edge, at least one said bulging portion having an embossed engaging portion formed on the outer surface thereof, the coil further comprising a wire disposed between the bulging portions and wound around the shaft, the wound wire having an outer circumferential surface;

a molded element formed by molding a molding material around the coil, the molding material covering the outer circumferential surface of the wound wire, portions of the bulging portions adjacent the wound wire, the outer circumferential edge of the bulging portion, inner circumferential surface regions defined by the hollow shaft and the outer surfaces of the bulging portions, including the embossed engaging portion thereof, the embossed engaging portion facilitating secure retention of the molded element on the coil.

8. A molded coil according to claim 7, wherein the embossed engaging portion is substantially annular and is disposed to substantially surround the shaft.

* * * * *